US008591055B2

(12) United States Patent
Leanza

(10) Patent No.: US 8,591,055 B2
(45) Date of Patent: Nov. 26, 2013

(54) ILLUMINATED CLIPBOARD AND METHOD OF USE

(76) Inventor: Anthony S. Leanza, Olmsted Township, OH (US)

( * ) Notice: Subject to any disclaimer, the term of this patent is extended or adjusted under 35 U.S.C. 154(b) by 1554 days.

(21) Appl. No.: 11/300,875

(22) Filed: Dec. 15, 2005

(65) Prior Publication Data

US 2006/0139909 A1 Jun. 29, 2006

Related U.S. Application Data

(60) Provisional application No. 60/639,702, filed on Dec. 28, 2004.

(51) Int. Cl.
*A47B 19/10* (2006.01)

(52) U.S. Cl.
USPC ..... 362/98; 362/99; 362/231; 40/124.02

(58) Field of Classification Search
USPC ..... 362/98, 99, 230, 231, 251; 40/124.02, 40/627
See application file for complete search history.

(56) References Cited

U.S. PATENT DOCUMENTS

| | | | | | |
|---|---|---|---|---|---|
| 1,456,927 | A | | 5/1923 | Kumpf | |
| 1,609,418 | A | * | 12/1926 | Nechamkin et al. | 362/99 |
| 1,978,553 | A | * | 10/1934 | Saunders | 362/99 |
| 2,395,760 | A | | 2/1946 | Quan | |
| 2,492,034 | A | * | 12/1949 | Clyne | 362/99 |
| 2,658,989 | A | * | 11/1953 | Marschat | 362/99 |
| 2,729,908 | A | * | 1/1956 | Miller | 40/661.01 |
| 2,806,715 | A | | 9/1957 | Smith | |
| 2,883,770 | A | * | 4/1959 | Lieb | 362/99 |
| 2,955,194 | A | * | 10/1960 | Clyne | 362/99 |
| 3,297,862 | A | * | 1/1967 | Levy et al. | 362/99 |
| 3,309,514 | A | | 3/1967 | Levy et al. | |
| 3,381,122 | A | * | 4/1968 | Boyle, Jr. | 362/99 |
| 3,500,034 | A | * | 3/1970 | Bissell | 362/98 |
| 3,670,370 | A | | 6/1972 | Goodwin | |
| 3,694,644 | A | * | 9/1972 | Bauknight | 362/99 |
| 3,697,737 | A | * | 10/1972 | Levkoff | 362/99 |
| 3,885,145 | A | * | 5/1975 | Wise | 362/99 |
| 3,947,926 | A | * | 4/1976 | Hart | 362/98 |
| 4,153,927 | A | | 5/1979 | Owens | |
| 4,243,249 | A | | 1/1981 | Goss | |
| 4,401,323 | A | * | 8/1983 | Rex | 281/45 |
| 4,577,788 | A | | 3/1986 | Richardson | |
| 4,614,450 | A | * | 9/1986 | Neiman | 40/124.2 |
| 4,751,620 | A | | 6/1988 | Wright et al. | |
| 4,805,680 | A | * | 2/1989 | Ueno | 40/654.01 |
| 4,892,334 | A | | 1/1990 | Sinclair | |

(Continued)

FOREIGN PATENT DOCUMENTS

GB 2 319 214 A 5/1998

OTHER PUBLICATIONS

Pending U.S. Leanza Design U.S. Appl. No. 29/236,451, filed Aug. 16, 2005 entitled Clipboard.

*Primary Examiner* — Ismael Negron

(57) ABSTRACT

An illuminated clipboard (100) includes a clipboard base (102), a license receiving/viewing device (106) located on the clipboard base, and an illumination source (150, 156) adapted to selectively illuminate the license receiving/viewing device. An illumination source (194) illuminates a ticket-holding area (104). Displays (180, 182) provide current date and time information and a future court date information. An auxiliary license holding slot (196) is provided having an auxiliary illumination source (210).

5 Claims, 6 Drawing Sheets

(56) References Cited

U.S. PATENT DOCUMENTS

| | | | | |
|---|---|---|---|---|
| D313,819 | S | 1/1991 | Craft, Jr. et al. | |
| 5,046,760 | A * | 9/1991 | Krepp | 281/45 |
| 5,145,141 | A * | 9/1992 | Hunter | 248/452 |
| 5,163,748 | A * | 11/1992 | Messinger | 362/98 |
| 5,176,438 | A | 1/1993 | Fisherman | |
| 5,388,530 | A | 2/1995 | Jacobus | |
| 5,471,347 | A * | 11/1995 | Galiani | 40/747 |
| 5,642,234 | A * | 6/1997 | Altman et al. | 359/802 |
| 5,829,787 | A | 11/1998 | Newhouse, Jr. | |
| 6,024,384 | A * | 2/2000 | Jones et al. | 281/45 |
| 6,241,360 | B1 * | 6/2001 | Merrell | 362/99 |
| 6,262,764 | B1 | 7/2001 | Perterson | |
| 6,302,563 | B1 | 10/2001 | Yama | |
| 6,443,588 | B1 | 9/2002 | Nunez | |
| 6,483,651 | B1 * | 11/2002 | Maurer | 359/819 |
| 6,637,907 | B1 * | 10/2003 | Levy | 362/98 |
| 6,691,442 | B2 * | 2/2004 | Gross | 40/495 |
| 6,764,192 | B2 * | 7/2004 | McChesney | 362/98 |
| 6,846,090 | B1 | 1/2005 | Smith | |
| 7,128,433 | B2 * | 10/2006 | Schlosser | 362/98 |
| 7,163,307 | B1 * | 1/2007 | Clark et al. | 362/99 |
| 7,270,437 | B1 * | 9/2007 | Racoosin et al. | 362/98 |
| 2003/0012013 | A1 * | 1/2003 | Herrera | 362/99 |
| 2003/0029985 | A1 | 2/2003 | Zeller et al. | |
| 2003/0070264 | A1 | 4/2003 | Villeneuve | |
| 2004/0099546 | A1 * | 5/2004 | Schlosser | 206/232 |
| 2004/0156125 | A1 * | 8/2004 | Graham et al. | 359/804 |
| 2005/0086840 | A1 * | 4/2005 | Tomaka | 40/367 |
| 2007/0115650 | A1 | 5/2007 | Cohan et al. | |

* cited by examiner

ILLUMINATED CLIPBOARD AND METHOD OF USE

RELATED PATENT APPLICATION

Priority is hereby claimed to U.S. Provisional Application No. 60/639,702, to Leanza entitled "Illuminated Clipboard" and filed Dec. 28, 2004, and which is hereby fully incorporated herein by reference.

TECHNICAL FIELD

The present invention relates to an illuminated clipboard apparatus and method for use and, more particularly, to an illuminated clipboard that assists a police officer in writing a traffic ticket and a method for issuing a traffic ticket using an illuminated clipboard.

BACKGROUND OF THE INVENTION

Clipboards are used for many different applications such as securely holding papers and providing a user with a portable and convenient writing surface. Because of their portability, clipboards are often used in an environment that is not otherwise conducive to holding papers and writing. For instance, police officers normally use a clipboard as an aid to issue traffic tickets at the site of a traffic stop. Traffic tickets may be issued at night when it is difficult for the issuing officer to efficiently fill out the ticket form using a traditional clipboard. It is hard for a police officer to view a driver's license and copy driver's information to the ticket form in a dark environment without returning to his vehicle. Though officers normally carry a flashlight, it is awkward for the officer to hold the flashlight while simultaneously holding the clipboard, writing, and reading the small print on the driver's license.

SUMMARY OF THE INVENTION

In an example of an embodiment of the present invention, an illuminated clipboard includes a clipboard base, a license receiving/viewing device located on the clipboard base, and a license illumination source adapted to selectively illuminate the license receiving/viewing device.

In another example of an embodiment of the present invention, an apparatus for supporting and illuminating at least one of a card and a form includes a clipboard base, a card receiving/viewing device mounted on the clipboard base, a card illuminator adapted to selectively illuminate the receiving/viewing device, a form-holding area adapted to removably hold the form to the clipboard base, and a form illuminator associated with the form-holding area and adapted to selectively illuminate the form-holding area.

In yet another example of an embodiment of the present invention, an illuminated clipboard includes a clipboard base, a license receiving/viewing device adapted to removably hold a license in at least one orientation, a first display adapted to display at least one of a current time and a current date, and a second display adapted to display at least one of a future time and a future date.

In another example embodiment of the present invention, an illuminated clipboard comprises a clipboard, a source of illumination, a magnifier, and a driver's license holder mounted to the clipboard for holding a driver's license under the magnifier, the driver's license being illuminated by the source of illumination.

In another example embodiment of the present invention, a clipboard for aiding a police officer in issuing traffic tickets comprises a clipboard, a traffic ticket holding area, a magnifier, a driver's license holder mounted to the clipboard for holding a driver's license under the magnifier, and a court date information indicator carried by said clipboard to indicate the appropriate court appearance date for an issued traffic ticket.

In yet another example of an embodiment of the present invention, a method is provided for issuing a ticket including the steps of obtaining a license from a driver to be ticketed, removably holding the license to a license receiving/viewing device associated with a clipboard base, and illuminating the license receiving/viewing device with a license illumination source associated with the license receiving/viewing device. The method also includes the steps of holding a traffic ticket blank to a ticket-holding area associated with the clipboard base, illuminating the ticket-holding area with a ticket illumination source, obtaining driver information from the license, obtaining at least one of current date and current time information from a first display on the clipboard, and obtaining at least one of future date and future time information from a second display on the clipboard. The method also includes the step of creating a completed traffic ticket by writing at least one of the driver information, current date and current time information, and future date and future time information on the traffic ticket blank.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF PREFERRED EMBODIMENT

Figure 1:
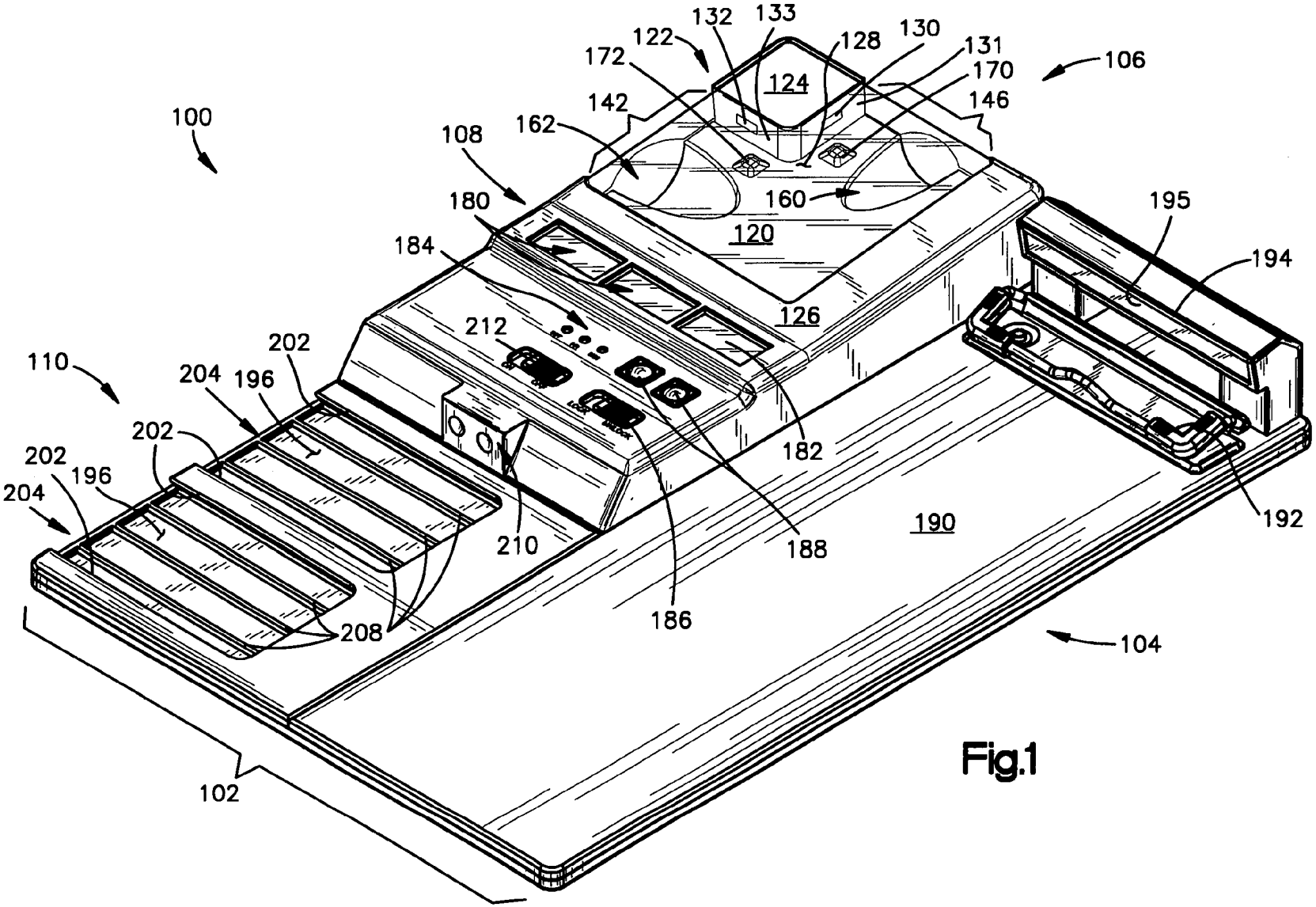
FIG. 1 is a perspective view of an example of an embodiment of the present invention.

Referring to FIGS. 1-5, one example embodiment of the present invention is shown. An illuminated clipboard 100, in accordance with one example embodiment, includes a clipboard base 102 having an illuminated ticket-writing area 104, an illuminated license receiving/viewing device 106, a date, clock, and court date information area 108, and an illuminated supplemental license receiving/holding area 110. The clipboard 100 may be made in dimensions other than that specifically shown and described depending on the particular desired use of the clipboard. For the purposes of explanation, the clipboard 100 is described as a police clipboard to aid police officers in issuing traffic tickets. The position of elements 104, 106, 108, and 110 of the clipboard 100 described herein may be positioned in locations other than that specifically shown, again, depending on the particular desired use of the clipboard. Those skilled in the art will appreciate that not all of the elements 104, 106, 108, and 110 are required for a clipboard in accordance with the present invention. The clipboard 100 may be made from any suitable material, including, but not limited to plastic, wood, chipboard, cardboard, metal, and the like or any combination of materials.

The illuminated license receiving/viewing device 106 of the clipboard 100 is located at one corner, e.g., upper left corner, of the clipboard base 102. The illuminated license receiving/viewing device 106 is also referred to herein as an information card receiving/viewing device. The license receiving/viewing device 106 is secured to or integrally formed as part of the clipboard base 102. The license receiving/viewing device 106 includes a bottom wall 120 of a recess 122 between surfaces 124 and 126. A lens 128 is received in the recess 122 and covers the bottom wall 120. In accordance with one example embodiment, the lens is a clear magnifying lens so that any item positioned adjacent the bottom wall 120, such as a driver's license, will be magnified. The lens 128 can be mounted and secured to the clipboard in the recess 122' by various means including snap fitting associated tabs (not shown) on the lens 128 into apertures 130, 132 in side walls 131, 133, respectively, and apertures 134, 136, and apertures 138, 140 (FIG. 3) of side walls 152, 154, respectively.

The lens 128 and the bottom wall 120 (FIG. 4) are spaced so as to form two rectangular narrow slit openings 142, 146, one on the left side of the clipboard 100 and one on the top side of the clipboard 100. The first opening 142 on the left side of the clipboard 100 is a rectangular narrow slit dimensioned commensurate with that of known driver's licenses having information arranged across the wider dimension of the license such as license 144 shown in FIG. 2. The second opening 146 at the top of the clipboard 100 formed by the lens 128 and the bottom wall 120 is a rectangular narrow slit dimensioned commensurate with that of known driver's licenses having information arranged across the narrower dimension of the license such as the license 148 shown in FIG. 2. When a license 144 or 148 is slid into the license receiving/viewing device 106, the information on the license can be viewed through the lens 128.

Two different illumination sources are provided to illuminate the license receiving/viewing device 106 of the clipboard 100 so as to aid in reading information on a driver's license 144 or 148 positioned by a clipboard user into one of the slots 142, 146 of the license receiving/viewing device 106. A first license light source 150, is located in side walls 152, 154 and positioned to direct light toward the recess 122 and light on a driver's license 144 or 148 in the receiving/viewing device 106. In accordance with one example embodiment of the present invention, the first light source is an ultraviolet light source. Driver's licenses 144 or 148 of certain states have information contained on them that can only be seen when placed under ultraviolet light. This information, not otherwise visible using light in the visible spectrum, is used to show, for example, that the driver's license 144 or 148 is authentic and not a forged or fake license. A second light source 156, such as four incandescent light bulbs, white light sources, or light emitting diodes ("LEDs"), are located in side walls 152, 154 and positioned to direct visible light toward the recess 122 so as to illuminate a driver's license 144 or 148 in the receiving/viewing device 106 to aid in viewing written information on the driver's license.

The words "license" and "card" are used herein to reference any sort of operator's license, ID card, credit or debit card, proof of insurance card, vehicle registration card, permit, order form, or other document which contains some sort of written or graphical information and is sized to be received in the receiving/viewing device 106 of the illuminated clipboard 100.

The license information is reviewable by a clipboard user who optionally copies information from the license 144 or 148 onto another document or form such as a traffic ticket or accident report held in the ticket-writing portion of the clipboard 104. The terms "form," "ticket," "ticket blank," "ticket form," and "report" are used herein to indicate any document or form, other than the viewed license 144 or 148, that is reviewed, referenced, or filled out by the party using the clipboard 100.

The lens 128 is, in accordance with one example embodiment, a magnifier lens that magnifies the license information to facilitate reading of printed information on the license 144 or 148. The ultraviolet light sources 150 and the plurality of visible light sources 156, when individually turned ON, illuminate the recess 122 from a transverse direction. The lens 128 may optionally be combined with the illumination sources 150, 156 to transmit light through the lens 128 for easy reading of the magnified license 144 or 148, or the illumination sources 150, 156 may illuminate the license with light emitted in the transverse direction but not primarily transmitted through the lens 128. Alternatively, the lens 128 could be a transparent cover.

Whether or not the license receiving/viewing device 106 includes a magnifier or transparent cover, the arrangement and dimensions of the sidewalls, the cover, and the bottom wall are such that they hold at least one type of information card depending on the desired use of the clipboard.

In one example embodiment, the license receiving/viewing device 106 includes finger openings 160, 162 to facilitate easy and complete insertion and removal of the licenses 148, 144, respectively, by a user. The user may insert a finger into the appropriate finger openings to urge the license 144 or 148 into or out of the license receiving/viewing device 106.

In accordance with one example embodiment, the license in accordance with one example embodiment, the license receiving/viewing device 106 includes pressure actuated momentary switches 170, 172 that extend up above the bottom wall 120 and are engaged by a leading edge of the license 148, 144, respectively, when inserted into the license receiving/viewing device 106. The license 144 or 148, upon being inserted, depresses the associated momentary switch downward, aided by force from the lens 128, in a pinching or compression action. The momentary switches 170, 172 are logically OR'ed so as to control the light sources 150, 156 via circuitry, not shown. The inserted license 148 or 144 holds the associated switch 170, 172 down until the license is removed. In accordance with one example embodiment, when one of the licenses 144 or 148 is first inserted and either switch is activated, only the light sources 150 are turned ON for a predetermined time period, e.g., 2 seconds, and then they are shut off. When the light sources 150 are shut off, the other visible light sources 156 are turned ON and remain ON until the license 144 or 148 is removed. This gives the clipboard operator time to view any hidden invisible information on the driver's license 144 or 148 prior to viewing the written information.

Optionally, the illuminated clipboard 100 includes a date, time, and court date information area 108. The information area 108 includes at least one of a first date/time display 180 and a second court date display 182. Often, a traffic ticket form provides space for an issuance date and time to be recorded on the ticket, requiring that the issuing officer consult a clock or calendar during issuance of the ticket. The first date/time display 180 is adapted to display at least one of a current date and time so that the issuing officer may quickly ascertain correct issuance information. Similarly, the ticket form often requires that the issuing officer assign a court appointment upon issuance of the ticket, so that the ticketed driver may appear in court personally to defend against the ticket. The assigned court appointment generally is automatically and arbitrarily chosen to be a business day in the future, e.g., a particular jurisdiction might always assign the first Monday at least two weeks after the issuance date. However, an officer issuing a ticket may have difficulty quickly calculating this sort of arbitrary time-based court appointment mentally, particularly if the officer is working near the (midnight) date change on an overnight shift or if the assigned court appointment based on such a set delay period would fall on a weekend, holiday, or otherwise outside business hours for the court. Thus, the illuminated clipboard 100 optionally includes a second court date display 182 adapted to display at least one of a future time and a future date, referred to herein as the court date. When provided, the future date and future time optionally indicate an appointed court date.

Optionally, the illuminated clipboard 100 includes a setting device 184 adapted to allow the clipboard user setting of the date/time display 180. Larger buttons 188 and a setting enable switch 186 are used to set the court date display. The setting enable switch 186 enables and disables the larger buttons 188 so that the court date is not accidentally changed if the larger buttons 188 are bumped, while still preserving the ease of use of the larger buttons in changing the court date as needed since the court date is changed on a frequent basis.

In accordance with one example embodiment, the displays 180, 182 are backlit displays that are backlit when a master power switch 220 of the clipboard 100 is activated ON. Otherwise, the information on displays 180, 182 can be viewed with reflective light.

The clipboard base 102 optionally further includes a ticket-writing area 104 having a ticket-holding area 190, which includes a ticket-clip 192 for removably holding a ticket form, or a book of ticket forms, to the clipboard base 102. The ticket-holding area 190 provides support for the ticket while the officer is copying information from the license onto the ticket. The ticket-clip 192 may be of any suitable type to hold the ticket to the clipboard base 102, including but not limited to a spring-loaded clip, a friction clip, an adhesive patch, a transparent cover, a set of posts adapted to mate with holes in the ticket, or the like. The precise nature of the ticket-clip 192 is not essential to the present invention and may be readily determined for a particular application by one of ordinary skill in the art. Optionally, a ticket-area illumination source 194 is adapted to selectively illuminate the ticket-holding area 190. The illumination source 194 includes a plurality of LED's oriented behind a glass or clear plastic cover 195 and oriented to direct visible light onto the ticket-holding area 190. The LED's of the illumination source 194 are turned ON and OFF via control of a master power switch 220.

Optionally, the illuminated clipboard 102 also includes at least one auxiliary license holding area 110 including at least one auxiliary license holding slot 196 adapted to removably hold an auxiliary license 200 to the clipboard base 102. In accordance with one exemplary embodiment, the auxiliary license 200 is held to the clipboard base 102 via channels 202 formed in a recess 204 dimensioned commensurate with a license. The bracket members 202 optionally are right-angle brackets 202 that form receiving channels 206 to receive and hold the edges of each auxiliary license 200. Each auxiliary license slot 196 may also include at least one spacing rib 208 which spaces or separates the auxiliary license 200 apart from the clipboard base 102 within the auxiliary license slot 196. The spacing ribs 208 facilitate sliding of the auxiliary license 200 into and out of the auxiliary license slot 196.

Optionally, an auxiliary license illumination source 210 is associated with the auxiliary license slot 196 and is adapted to selectively illuminate the auxiliary license 200 or other information card placed into the auxiliary slots 196. For example, a pressure switch much like the pressure switches 170, 172 could be used to automatically actuate the illumination source 210 when an auxiliary license 200 is inserted. Optionally, an illumination source switch 212, which may be a slide switch, is used to selectively control the illumination source 210.

Optionally, a master switch 220 simultaneously turns ON and OFF the illumination sources 194 and 210 and the backlit function of displays 180, 182. When the master switch 220 is on, the illuminating source 210 can be controlled by switch 212. The clipboard 100, in one example embodiment, includes rechargeable internal batteries that can be recharged by connection to a vehicle via a plug-in adapter or a wall plug charger arrangement (not shown).

Optionally, a pen/pencil clip 230 is provided on the clipboard base 102 to facilitate attachment of a writing instrument to the illuminated clipboard 100 for the user's convenience.

Figure 7:
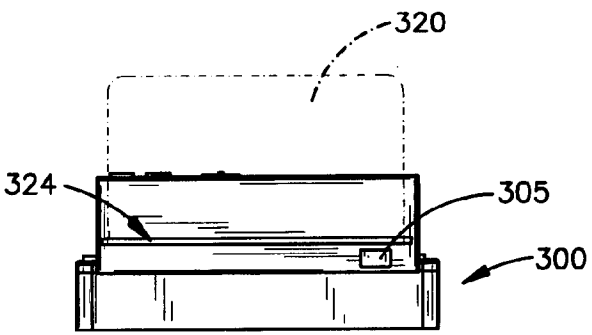
FIG. 7 is a back elevation view of the embodiment shown in FIG. 6.
Figure 6:
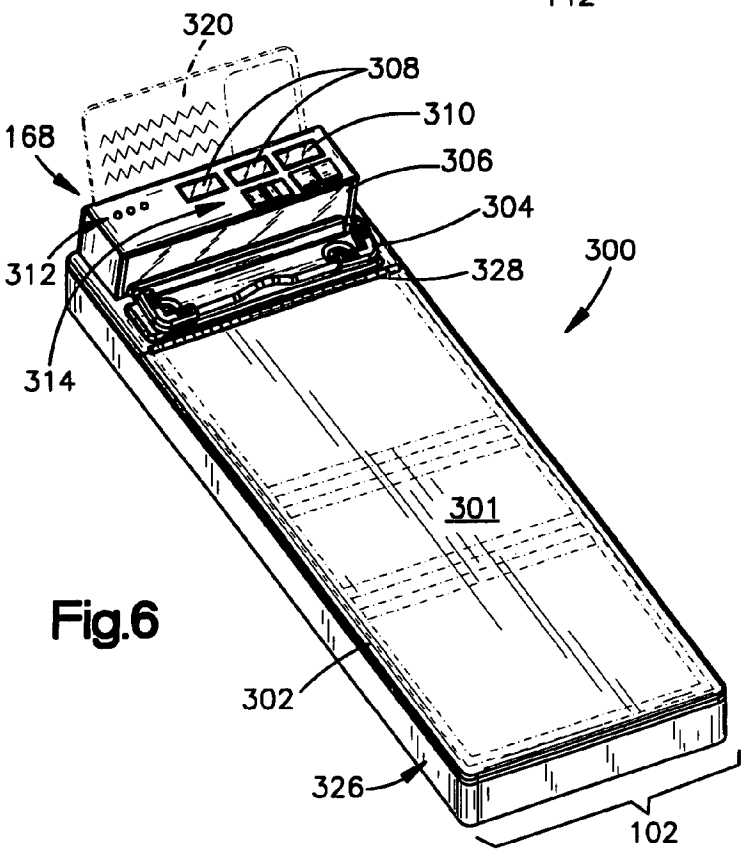
FIG. 6 is a perspective view of another example embodiment of the present invention.

FIGS. 6 and 7 depict another example embodiment of the illuminated clipboard 300. The illuminated clipboard 300 shown in FIGS. 6 and 7 may be particularly suited for use by a motorcycle policeman because of its compact size. A traffic ticket 301 is held to a ticket-holding area and cover 302 by a ticket-clip 304. A master switch 305 controls an illumination source 306. The illumination source 306 includes a plurality of LEDs that direct visible light onto the ticket-writing area when the switch 305 is activated ON. First date/time display 308 displays a current date/time and a second display 310 displays a future date/time such as a court date. Setting device 312 may be used to selectively change the current date/time and setting device 314 is used to selectively change a future date/time. In this example embodiment, the license 320 is held upright by a license-holding groove or slot 324 near the ticket-holding area and adapted to allow a user to easily see both the license 320 and the traffic ticket blank 301 at the same time. The displays 308 and 310 are backlit and controlled by the power switch 305.

The illuminated clipboard 300 has a storage compartment 326 for storage of a tickets and is accessible by having the ticket-holding area and cover 302 hinged via a hinge 328 connected to the main body portion of the illuminated clipboard 300.

Figure 8:
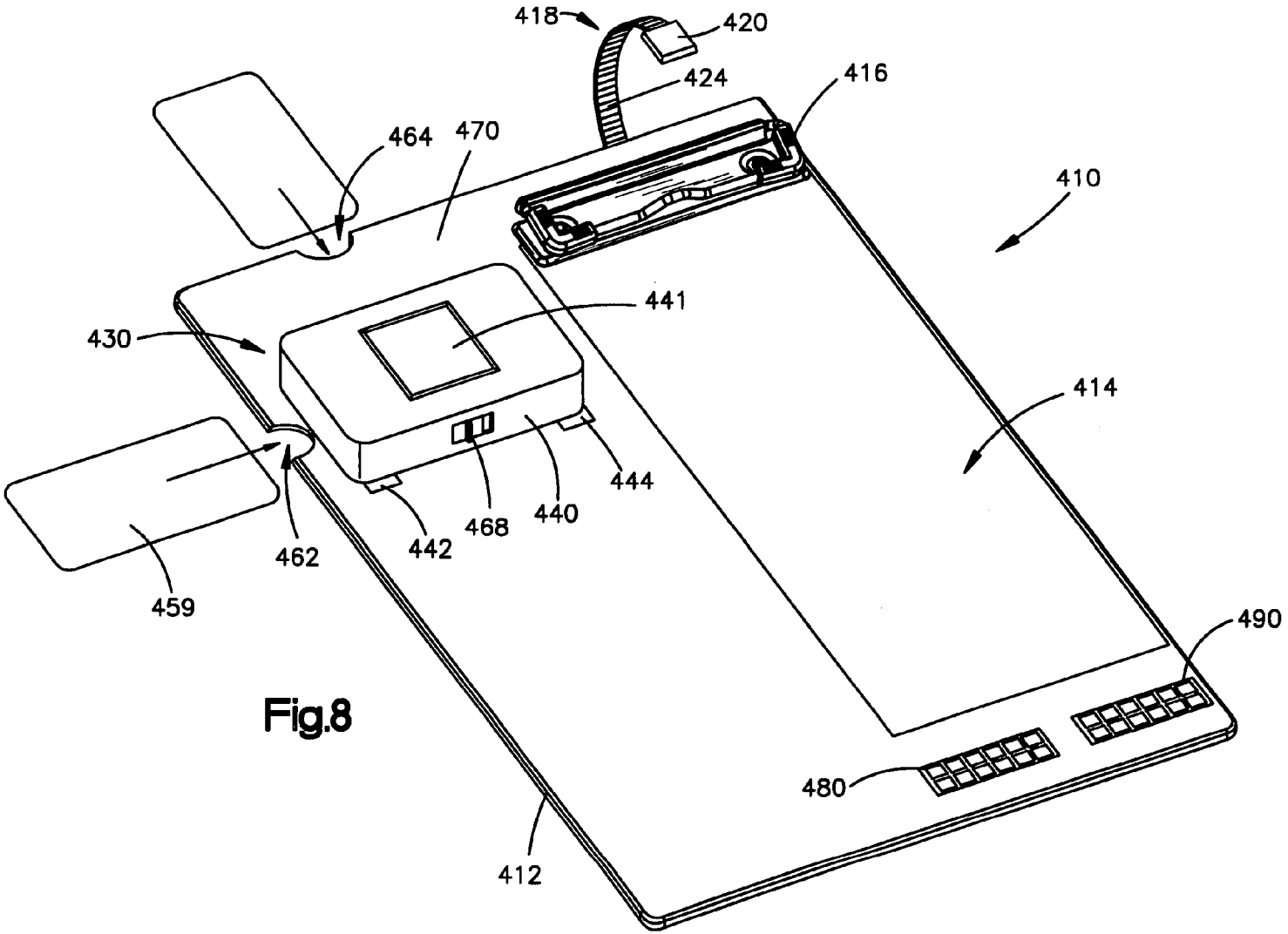
FIG. 8 is a top perspective view of another example embodiment of the present invention.
Figure 9:
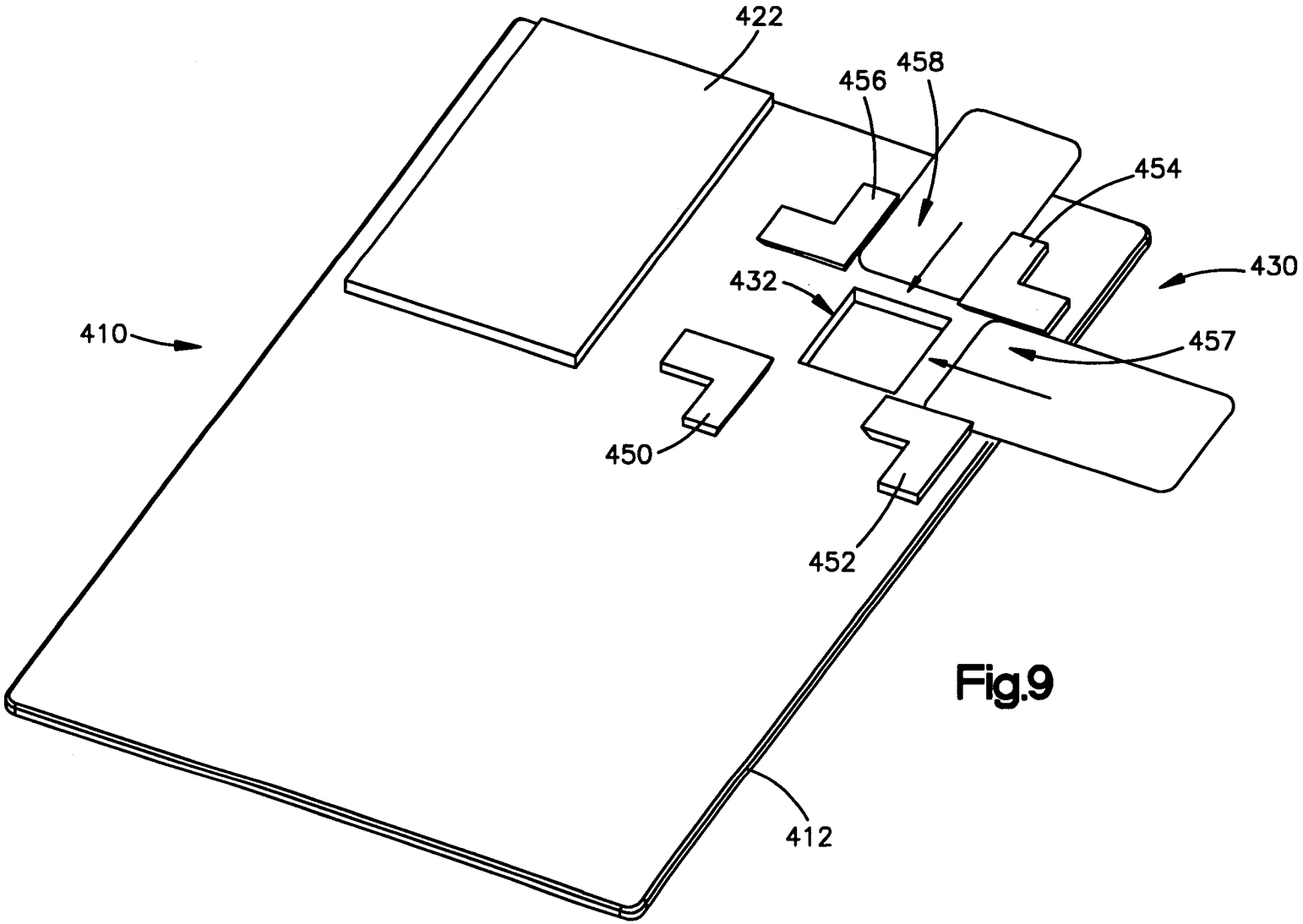
FIG. 9 is a bottom perspective view of the example embodiment shown in FIG. 8.

Referring to the FIGS. 8 and 9, a clipboard assembly 410 in accordance with another example embodiment of the present invention includes a clipboard base 412 with a ticket place-holding location 414. A clipboard clip 416 is secured to the clipboard base 412 near one end and position to securely hold a traffic ticket on the ticket place-holding location 414 to allow a police officer to fill out the ticket during a traffic stop. A rechargeable light assembly 418 having a light source 420 and a rechargeable battery 422 is secured to the clipboard base 412. The battery 422 is secured on the back of the clipboard base 412. The battery 422 could be a replaceable battery.

The light source 420 lights the ticket place-holding location 414 to aid a police officer seeing a traffic ticket at night. The light assembly 418 has a telescoping neck 424 that is received into the battery 422. The telescoping neck 424 controls an internal on/off switch within the battery 422 for on/off control of the light source 420 to conserve battery life. When the neck is retracted into the battery, the light source 420 is switched off. Then the neck 424 is extended, the light source 420 is switched on. The light source 420 may be pivotally mounted to the end of the neck 424 to aid in directing the light. The neck 424 may be serpentine for more flexibility.

The clipboard base 412 also includes a license viewer location 430 having an opening 432. An illuminated magnifier assembly 440 is secured to the clipboard base 412 by appropriate means so as to position the magnifier assembly 440 over the opening 432. The magnifier assembly 440 includes a magnification lens 441 surrounded by a battery powered light source. When the light source is switched on, objects under the lens 441 become illuminated.

Spaced apart Velcro strips 442, 444 may be used for securing the magnifier assembly 440 to the clipboard base 412 so as to make the illuminated magnifier assembly 440 removable and replaceable.

License holder or brackets 450, 452, 454, 456 are located on, and secured, to the back of the clipboard base 412 and spaced to hold a driver's license 459 which slid in from the side. The holders 450, 452, 454, and 456 are L-shaped brackets that form two separate receiving channels 457, 458 to receive and hold driver's licenses. The spacing and width of the channels 457 and 458 are appropriate for the driver's licenses for the state where the board is being used.

The driver's license is received in the channels of the holders and slid into the channels so as to align with the opening 432 and to be viewable with the magnifier assembly 440 from the top side of the clipboard. The two separate channels of the holders are provided to accommodate two different size licenses that may be issued by one state.

Notches 462, 464 are formed in the clipboard base 412 to aid in the removal of the driver's license after the officer writes the traffic ticket. The illuminated magnifier assembly 440 aids the officer in seeing the details on the driver's license particularly at night. The illuminator for the magnifier assembly also has an on/off slide switch 468 to preserve battery life. The battery of the illuminated magnifier assembly 440 may be rechargeable or replaceable.

The clipboard 410 further includes a time and date display 380 and a court date display 490 mounted thereto. Both of these displays are settable by the police officer and aid the police officer in providing information necessary to be added to the traffic ticket during a traffic stop. Both displays are backlit illuminated to aid the police officer at night.

Figure 2:
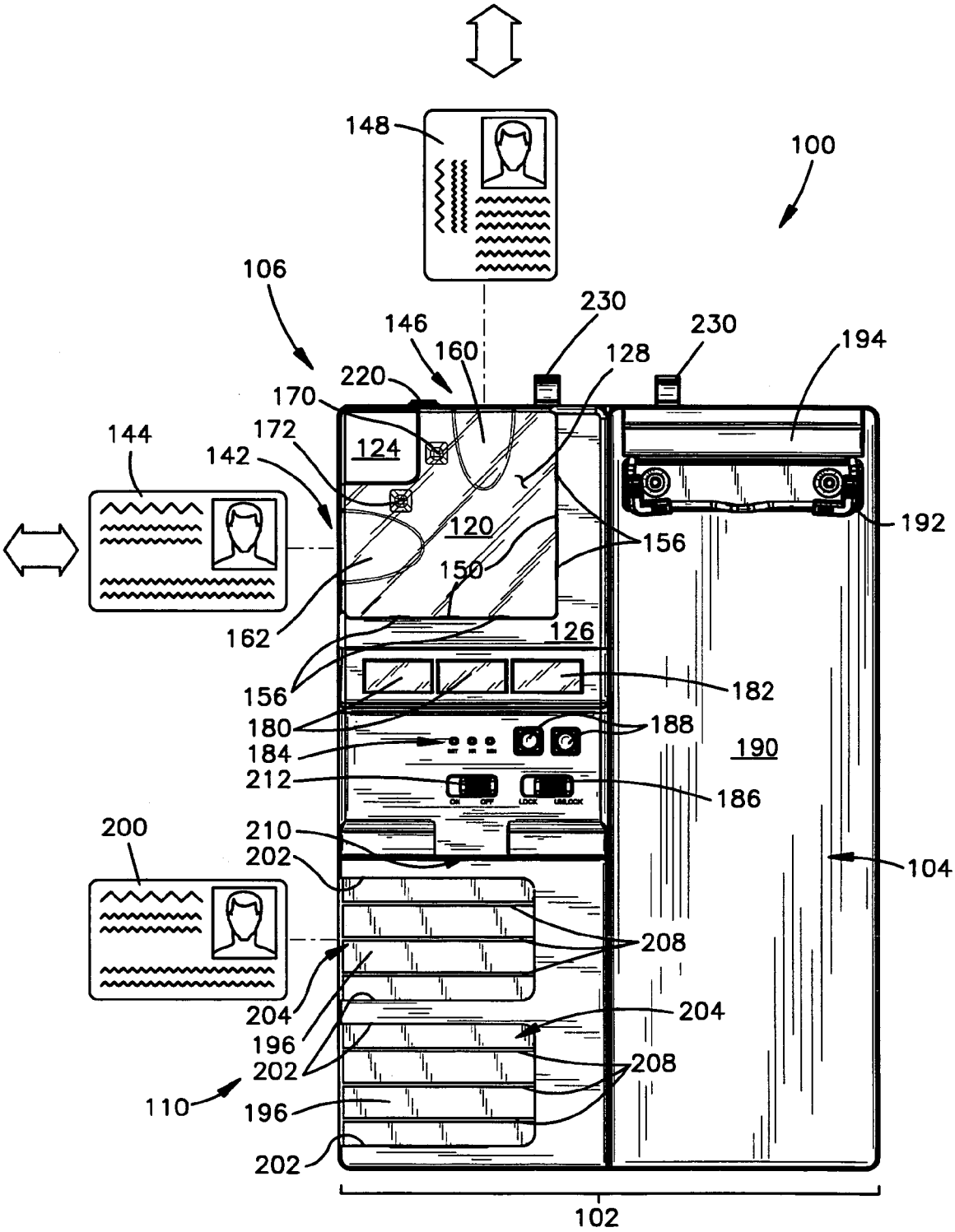
FIG. 2 is a top plan view of the embodiment shown in FIG. 1 showing how drivers' licenses could be slid into a receiving/viewing device of the present invention.
Figure 3:
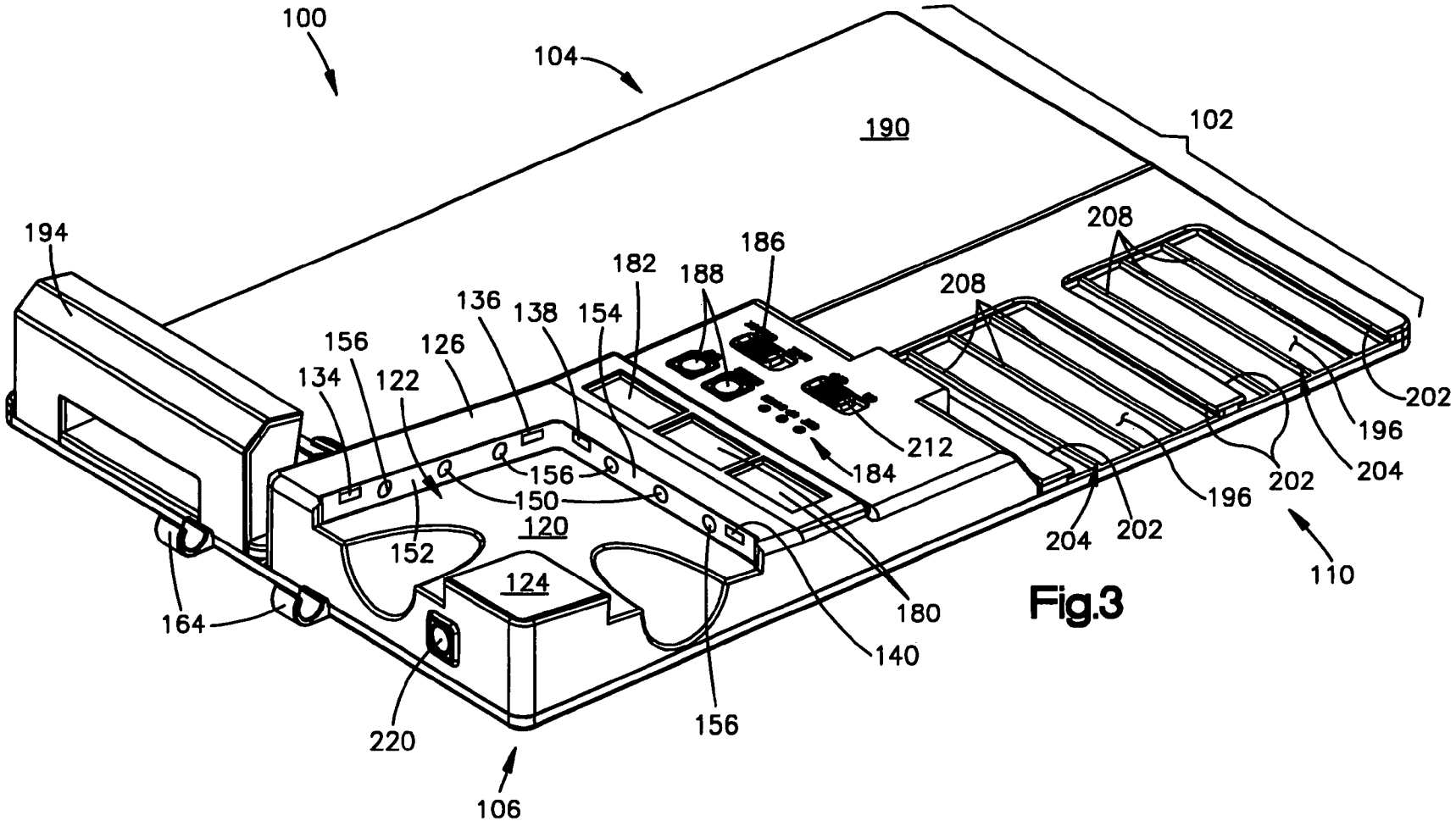
FIG. 3 is another perspective view of the embodiment shown in FIG. 1.
Figure 4:
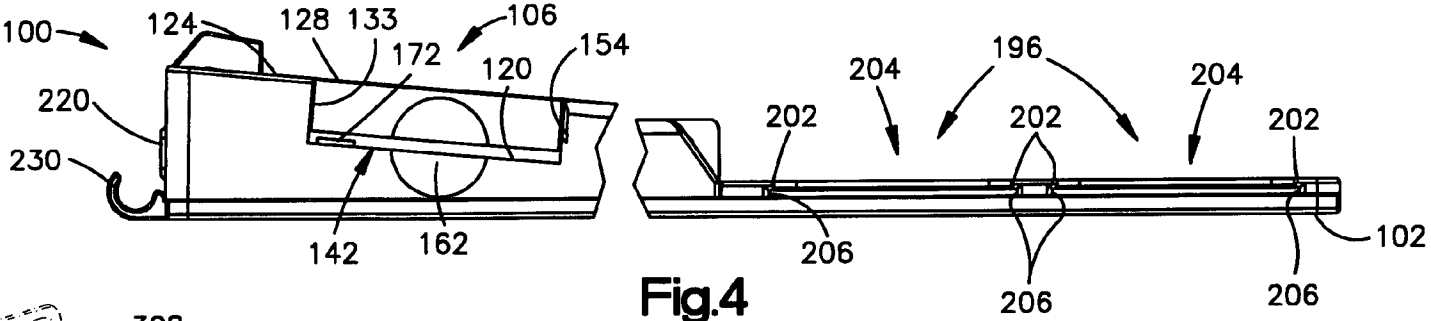
FIG. 4 is a partial side elevational view of the embodiment shown in FIG. 1.
Figure 5:
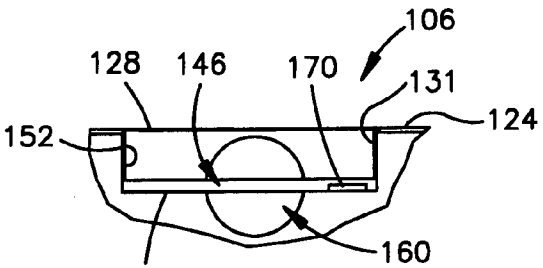
FIG. 5 is a partial side elevational view of a portion of the embodiment shown in FIG. 1.

A police officer may issue a traffic ticket at night using the example embodiment of the invention shown in FIGS. 1-5. Such officer pulls over the violating car and obtains a license from the driver to be ticketed. Optionally, the officer also obtains at least one other document, e.g., proof of insurance from the driver or a license of a passenger in the car. The officer activates the master switch 220 that illuminates the ticket-holding area 190 with the illumination source 194. He places the license 144 or 148 into the license receiving/viewing device 106. Sliding the license into the license receiving/viewing device 106 as shown in FIG. 2 depresses an associated one of the pressure switches 170, 172 to illuminate the license receiving/viewing device 106 first with the ultraviolet light source 150 for a predetermined time and then with the visible light source 156. The magnifier lens 128 associated with the license receiving/viewing device 106 assists in making the driver information easily readable.

The officer holds a traffic ticket blank to the ticket-holding area 190 with clip 192. The illumination source 194 illuminates the ticket-holding area 190 when the master switch 220 is activated. The illumination source 194 allows the officer to clearly see to write the driver information on the traffic ticket blank.

The officer obtains information from the license 144 or 148, at least one of current date and current time information from the display 180, and at least one of future date and future time information from the display 182. When all of the desired information has been obtained, a completed traffic ticket is created by the officer's writing at least one of the driver information, current date and current time information, and future date and future time information on the traffic ticket blank.

If the officer has collected at least one auxiliary license 200, such auxiliary license 200 or proof of insurance card may be held to the clipboard base 102 in the auxiliary license slot 196, when provided. In such case, the illumination source 210 may be used to selectively illuminate the auxiliary license 200 or proof of insurance card, through use of the illumination source switch 212 once the master switch 220 has enabled the illumination source 210. The officer can then readily collect any desired information from the auxiliary license 200 or proof of insurance card, simultaneously or in series with collecting driver information using the license receiving/viewing device 106.

From the above description of the invention, those skilled in the art will perceive improvements, changes and modifications in the invention. Such improvements, changes and modifications within the skill of the art are intended to be covered by the appended claims.

Having described the invention, the following is claimed:

1. An illuminated clipboard comprising:
- a clipboard;
- a source of illumination;
- a magnifier; and
- a driver's license holder mounted to the clipboard for holding a driver's license under the magnifier, said driver's license holder being transparent so that information on a driver's license can be viewed through said driver's license holder, the driver's license being illuminated by the source of illumination.

2. A clipboard for aiding a police officer in issuing traffic tickets comprising:
- a clipboard;
- a traffic ticket holding area;
- a magnifier;
- a driver's license holder mounted to the clipboard for holding a driver's license under the magnifier, said driver's license holder being transparent so that information on a driver's license can be viewed through said driver's license holder; and
- a court date information indicator carried by said clipboard to indicate the appropriate court appearance date for an issued traffic ticket.

3. A method of issuing a traffic ticket, comprising the steps of:
- obtaining a license from a driver to be ticketed;
- removably holding the license to a license receiving/viewing device associated with a clipboard base;
- illuminating the license receiving/viewing device with a license illumination source associated with the license receiving/viewing device;
- holding a traffic ticket blank to a ticket-holding area associated with the clipboard base;
- illuminating the ticket-holding area with a ticket illumination source;
- obtaining driver information from the license;
- obtaining at least one of current date and current time information from a first display on the clipboard;
- obtaining at least one of future date and future time information from a second display on the clipboard; and creating a completed traffic ticket by writing at least one of the driver information, current date and current time information, and future date and future time information on the traffic ticket blank.

4. The method of claim 3, including the steps of:

obtaining at least one auxiliary information card; and attaching the auxiliary information card to the clipboard base.

5. The method of claim 4, including the step of illuminating the auxiliary information card with an auxiliary illumination source.

* * * * *